US007891206B2

(12) United States Patent
Yoon et al.

(10) Patent No.: US 7,891,206 B2
(45) Date of Patent: Feb. 22, 2011

(54) DEHUMIDIFIER

(75) Inventors: Sang-Youn Yoon, Busan-si (KR); Won-Suk Jang, Busan-si (KR)

(73) Assignee: LG Electronics Inc., Seoul (KR)

( * ) Notice: Subject to any disclaimer, the term of this patent is extended or adjusted under 35 U.S.C. 154(b) by 157 days.

(21) Appl. No.: 11/988,100

(22) PCT Filed: Oct. 24, 2006

(86) PCT No.: PCT/KR2006/004347

§ 371 (c)(1),
(2), (4) Date: Sep. 10, 2008

(87) PCT Pub. No.: WO2007/049903

PCT Pub. Date: May 3, 2007

(65) Prior Publication Data

US 2009/0120118 A1 May 14, 2009

(30) Foreign Application Priority Data

Oct. 24, 2005 (KR) ..... 10-2005-0100255
Oct. 24, 2005 (KR) ..... 10-2005-0100258

(51) Int. Cl.
*F25D 21/14* (2006.01)

(52) U.S. Cl. ..... 62/286; 62/291; 220/23.87; 312/325

(58) Field of Classification Search ..... 62/286, 62/291; 220/23.87, 908, 909; 312/325–328
See application file for complete search history.

(56) References Cited

U.S. PATENT DOCUMENTS

| | | | | | |
|---|---|---|---|---|---|
| 1,181,526 | A * | 5/1916 | Hawk | 312/235.5 |
| 1,895,291 | A * | 1/1933 | Meyer | 232/43.1 |
| 2,682,758 | A * | 7/1954 | Harris | 62/291 |
| 4,554,794 | A * | 11/1985 | Khan | 62/150 |
| 4,953,364 | A * | 9/1990 | Lee | 62/285 |
| 5,215,365 | A * | 6/1993 | Godin | 312/328 |
| 5,381,921 | A * | 1/1995 | Bray et al. | 220/495.08 |
| 5,421,252 | A * | 6/1995 | Reichel | 100/193 |
| 5,884,495 | A * | 3/1999 | Powell et al. | 62/150 |
| 5,890,615 | A * | 4/1999 | Petras | 220/23.86 |
| 6,193,091 | B1 * | 2/2001 | Olivetti | 220/23.88 |
| 6,334,542 | B1 * | 1/2002 | Hsu | 220/263 |
| 2006/0261143 | A1 * | 11/2006 | Sola Barbarin et al. | 232/43.1 |

* cited by examiner

*Primary Examiner*—William E Tapolcai
(74) *Attorney, Agent, or Firm*—McKenna Long & Aldridge LLP

(57) ABSTRACT

A dehumidifier is provided. The dehumidifier includes a cabinet defining an outer appearance of the dehumidifier, a barrier installed in the cabinet to collect condensed water, and a bucket assembly received in the barrier to store the condensed water, the bucket assembly being capable of pivoting frontward.

13 Claims, 11 Drawing Sheets

[Fig. 1]
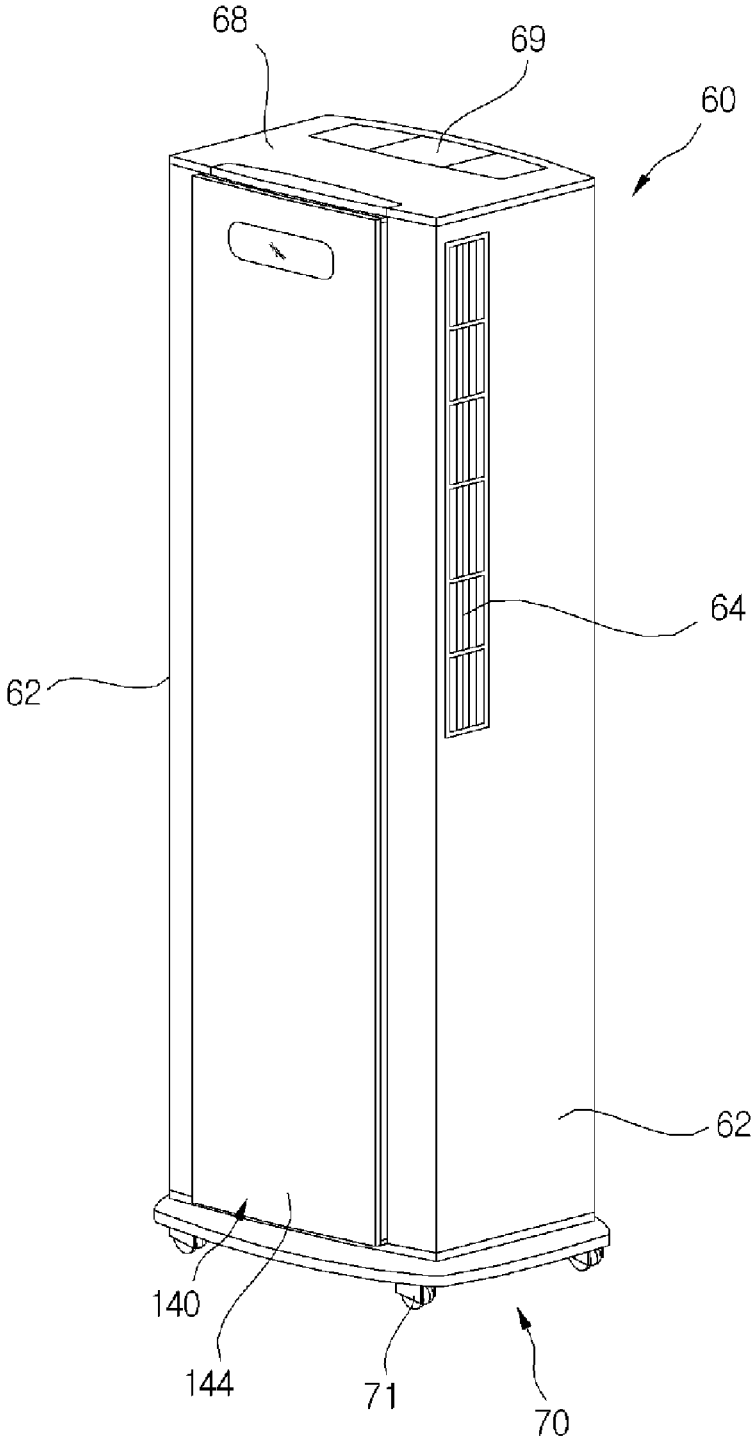

[Fig. 2]
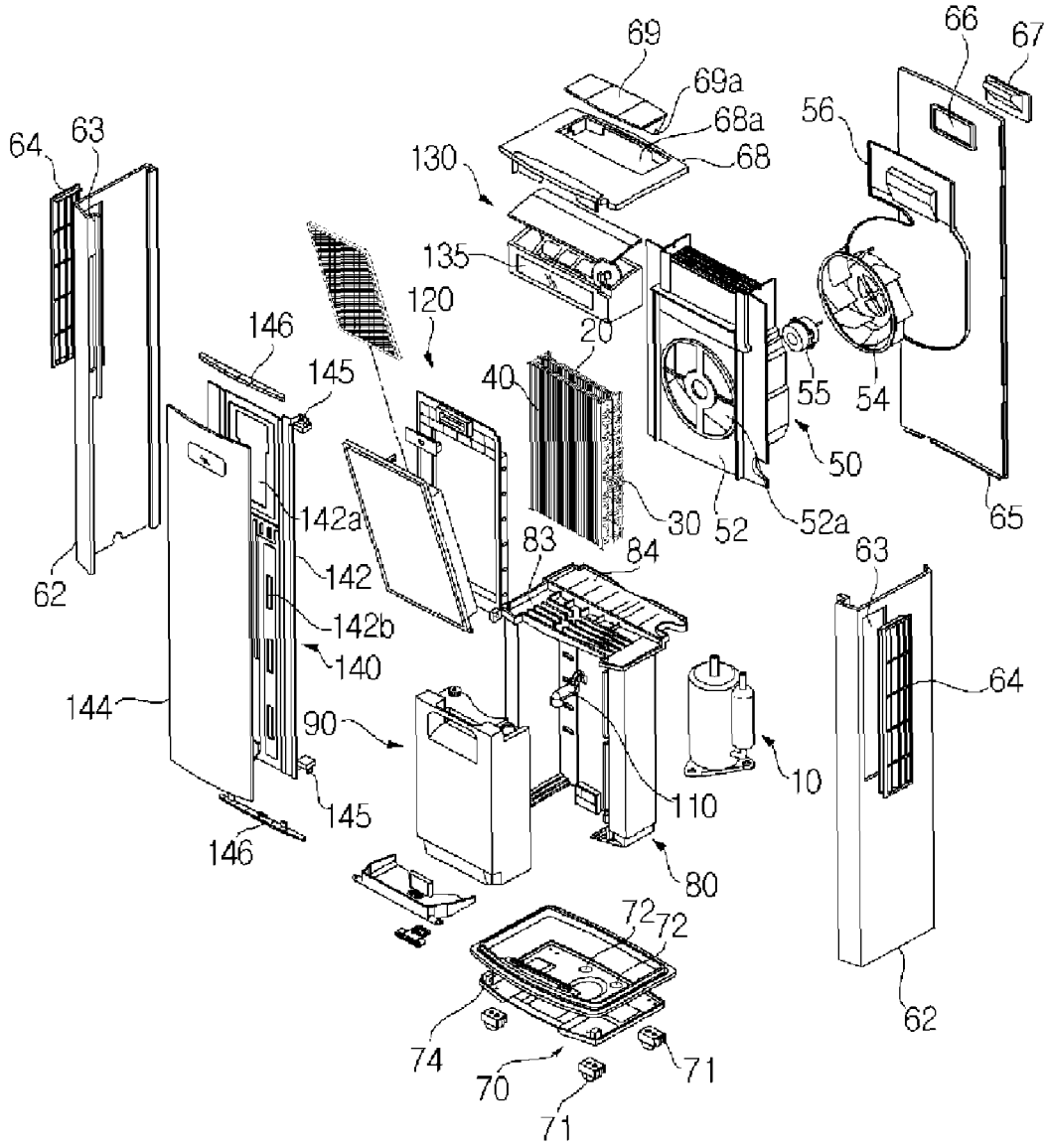

[Fig. 3]
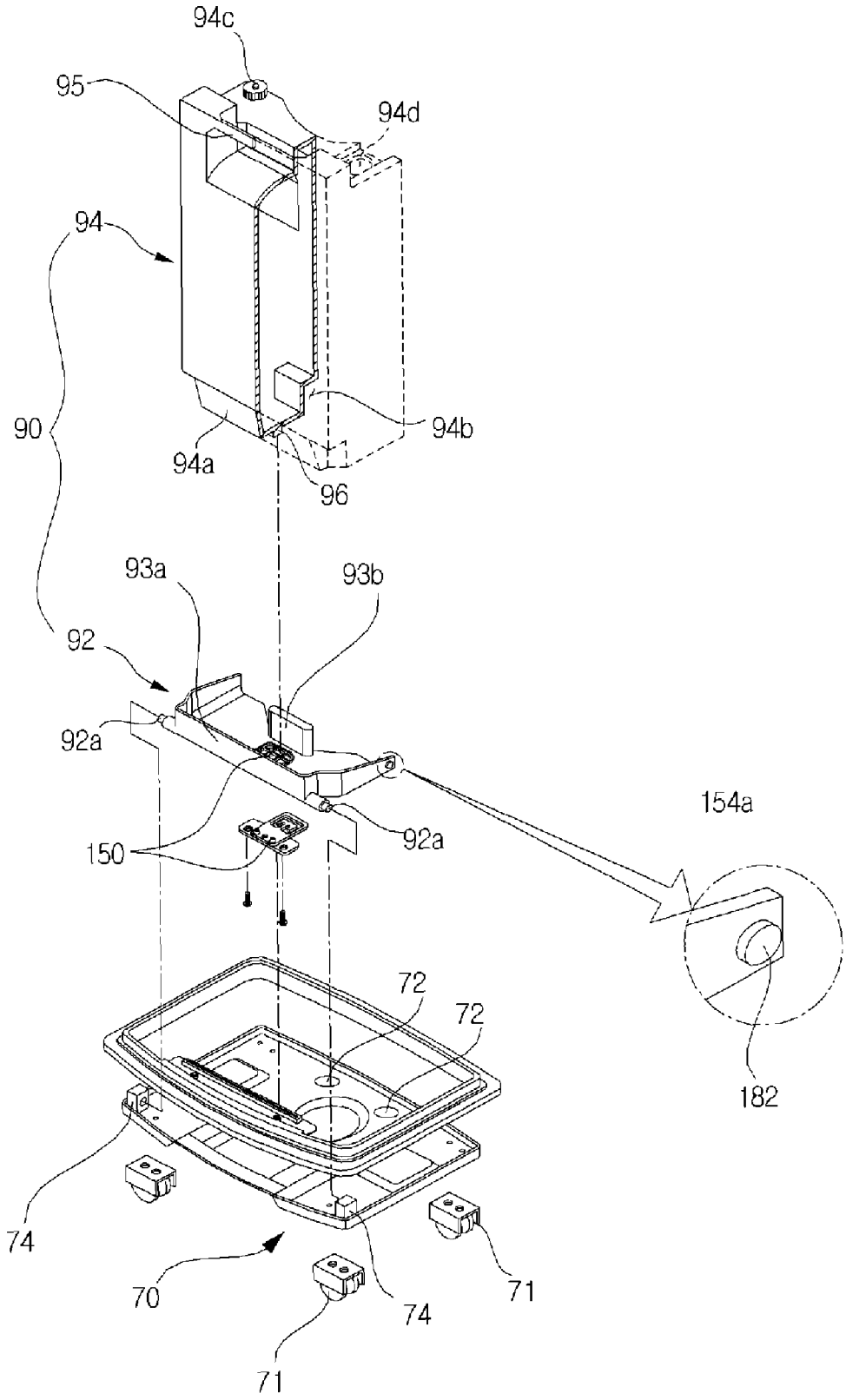

[Fig. 4]
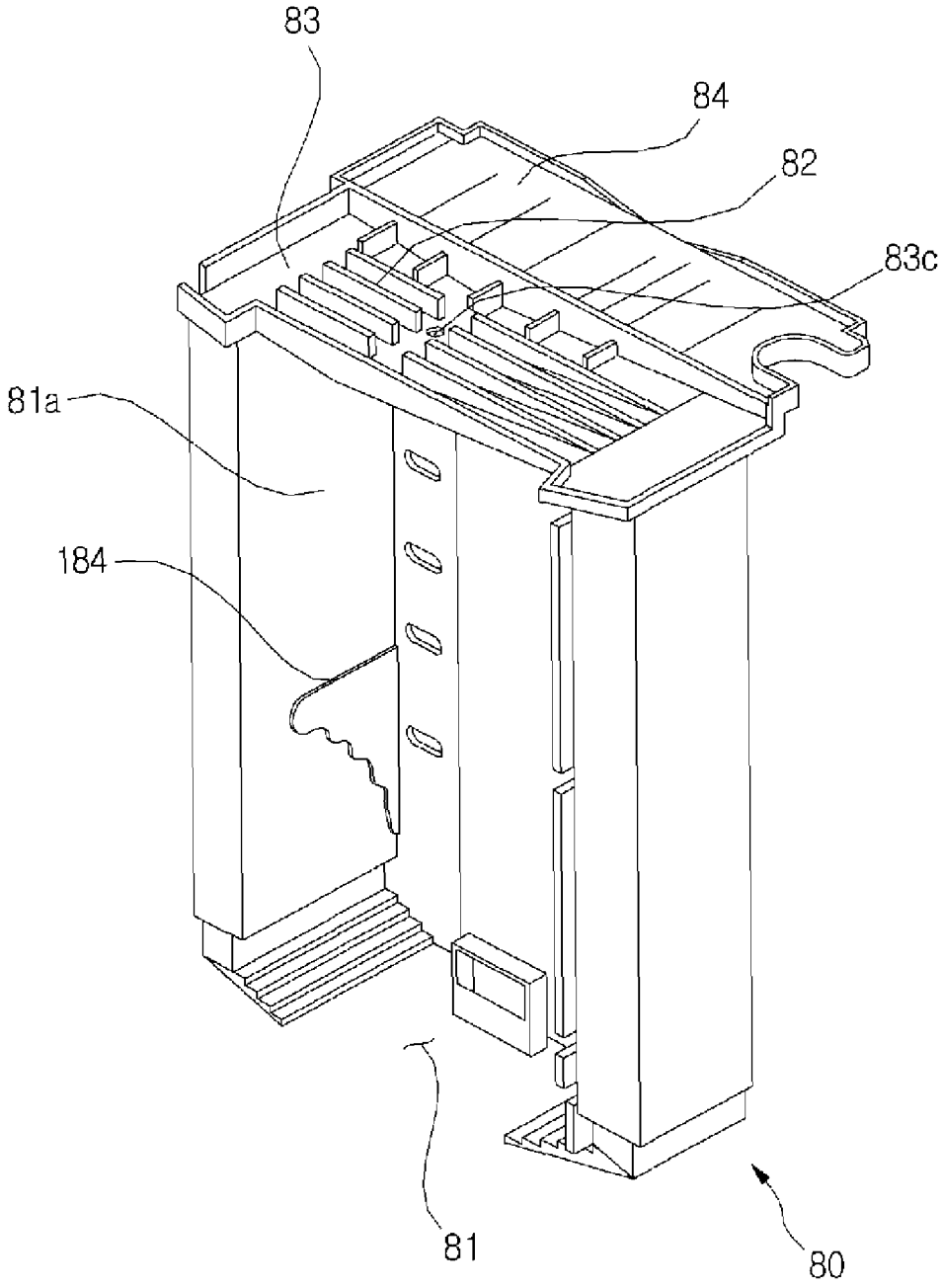

[Fig. 5]
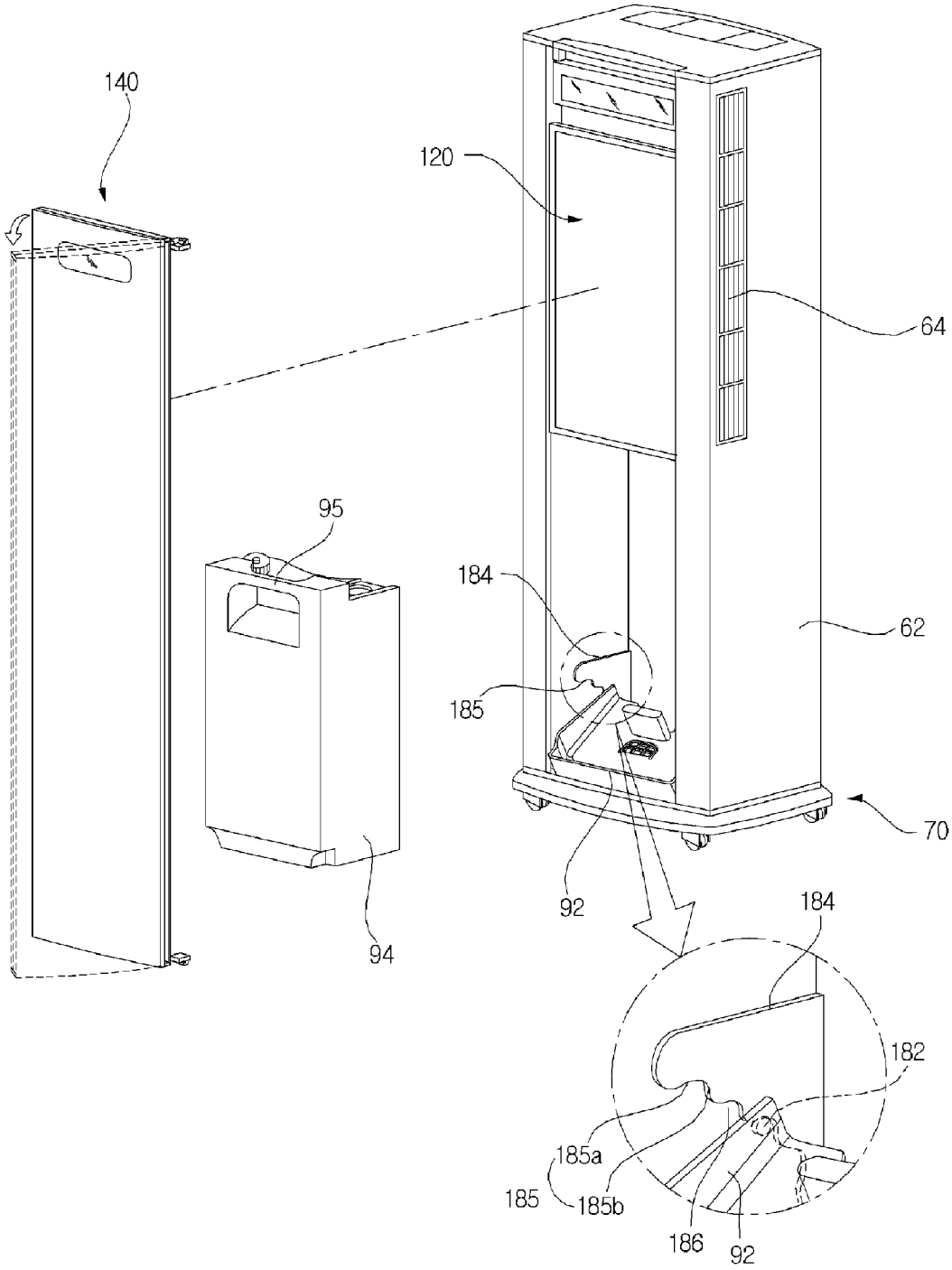

[Fig. 6]
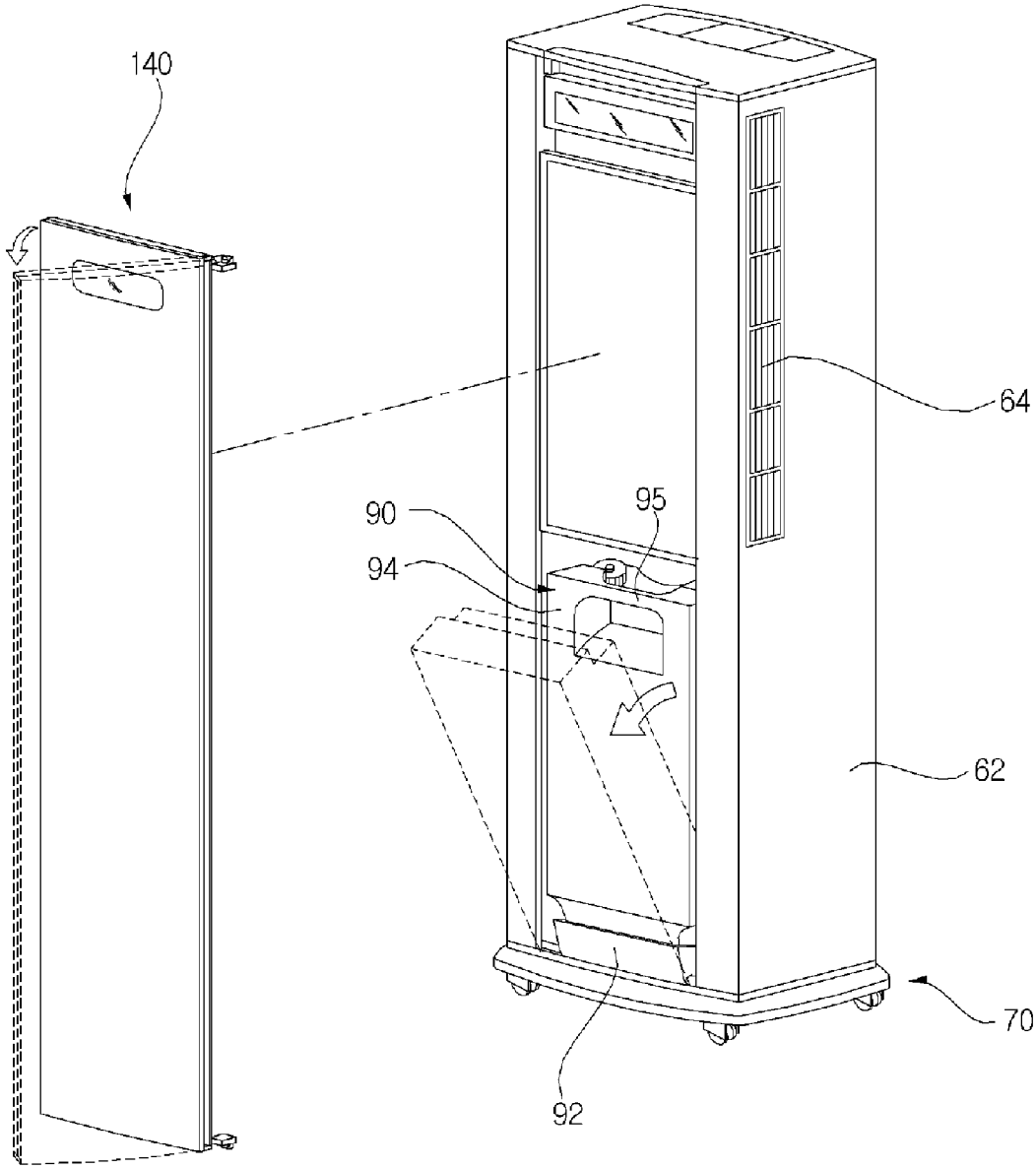

[Fig. 7]
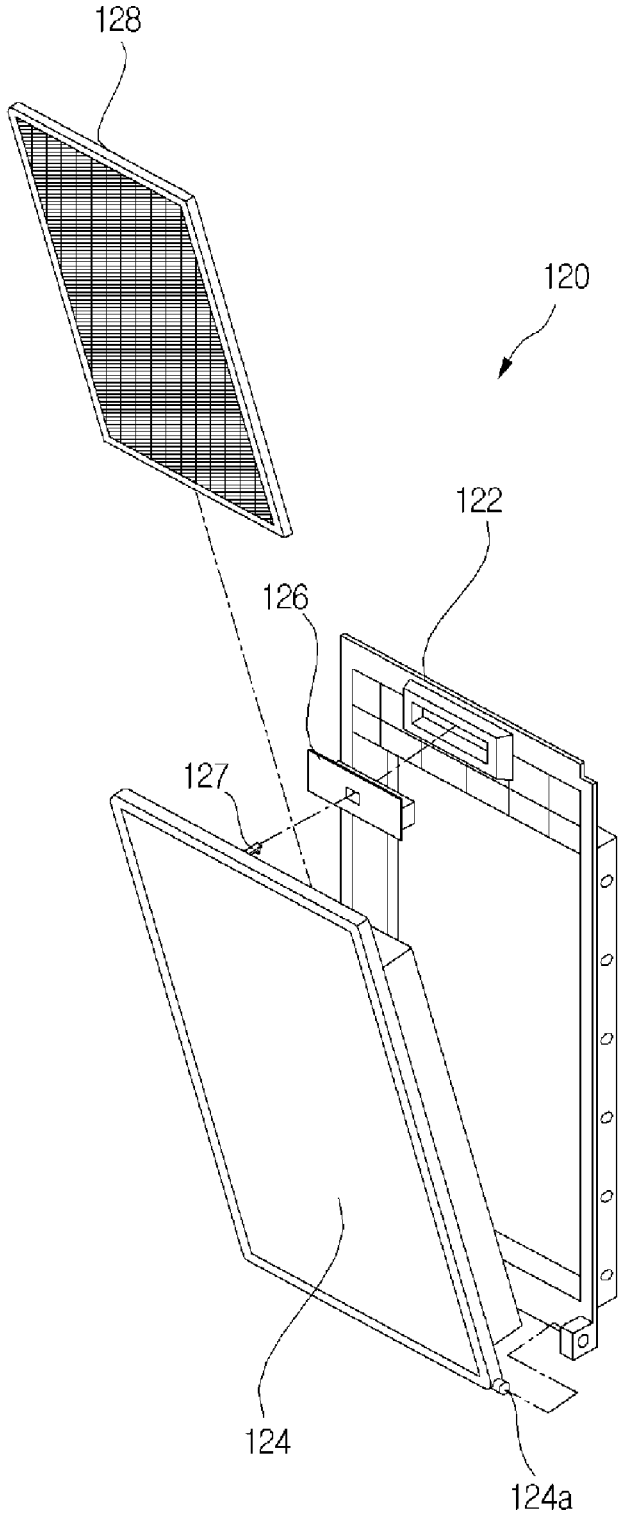

[Fig. 8]
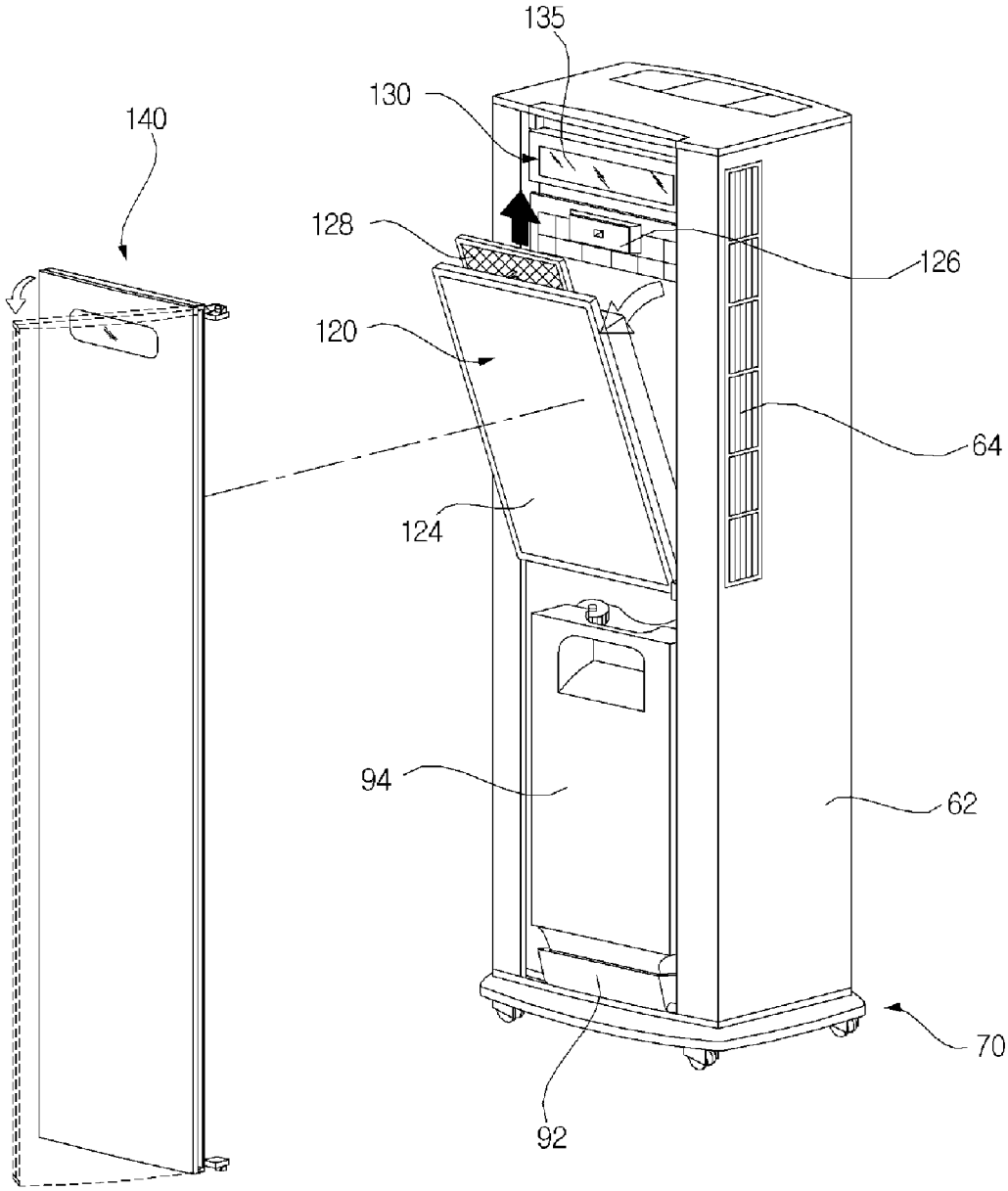

[Fig. 9]
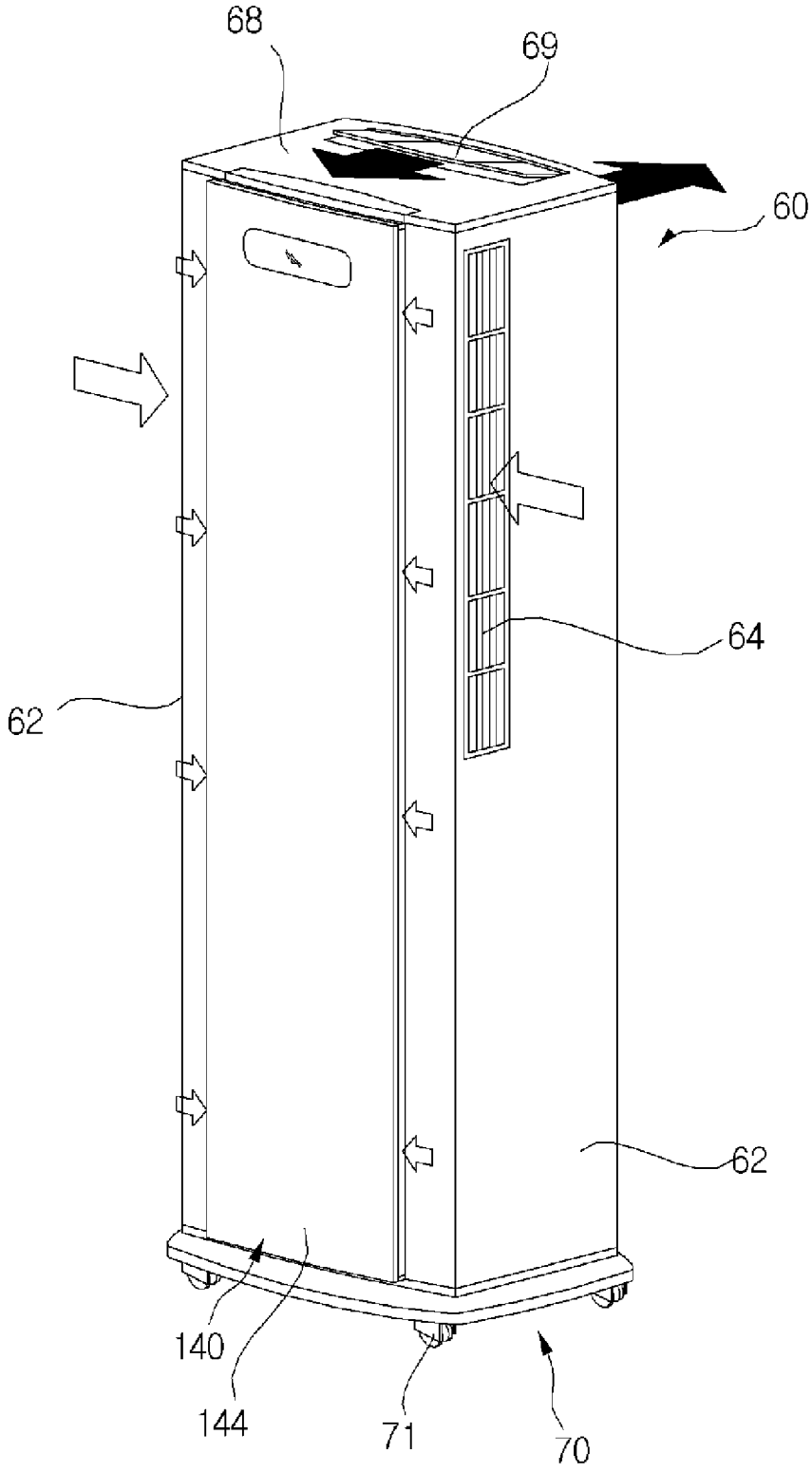

[Fig. 10]
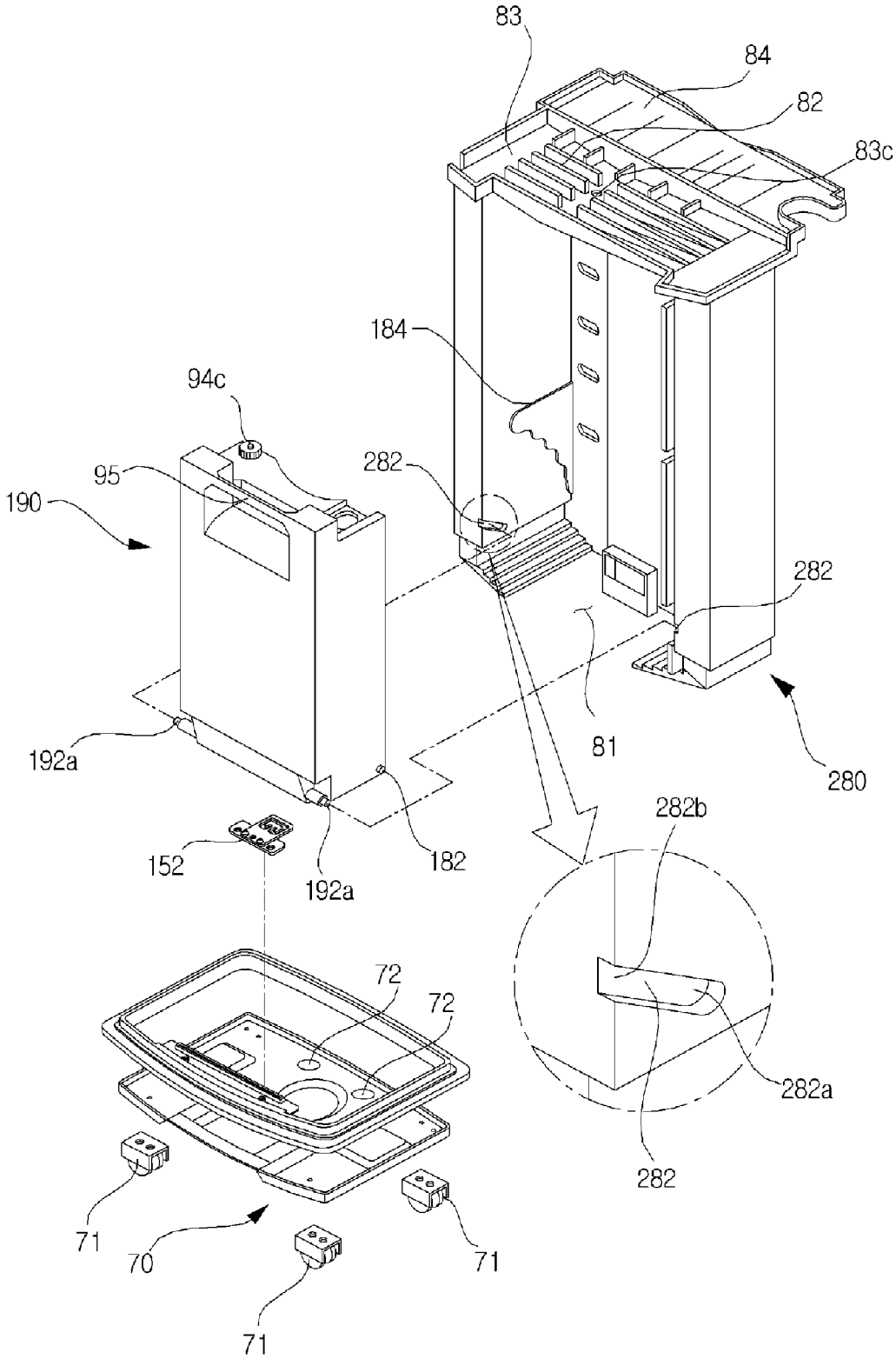

[Fig. 11]
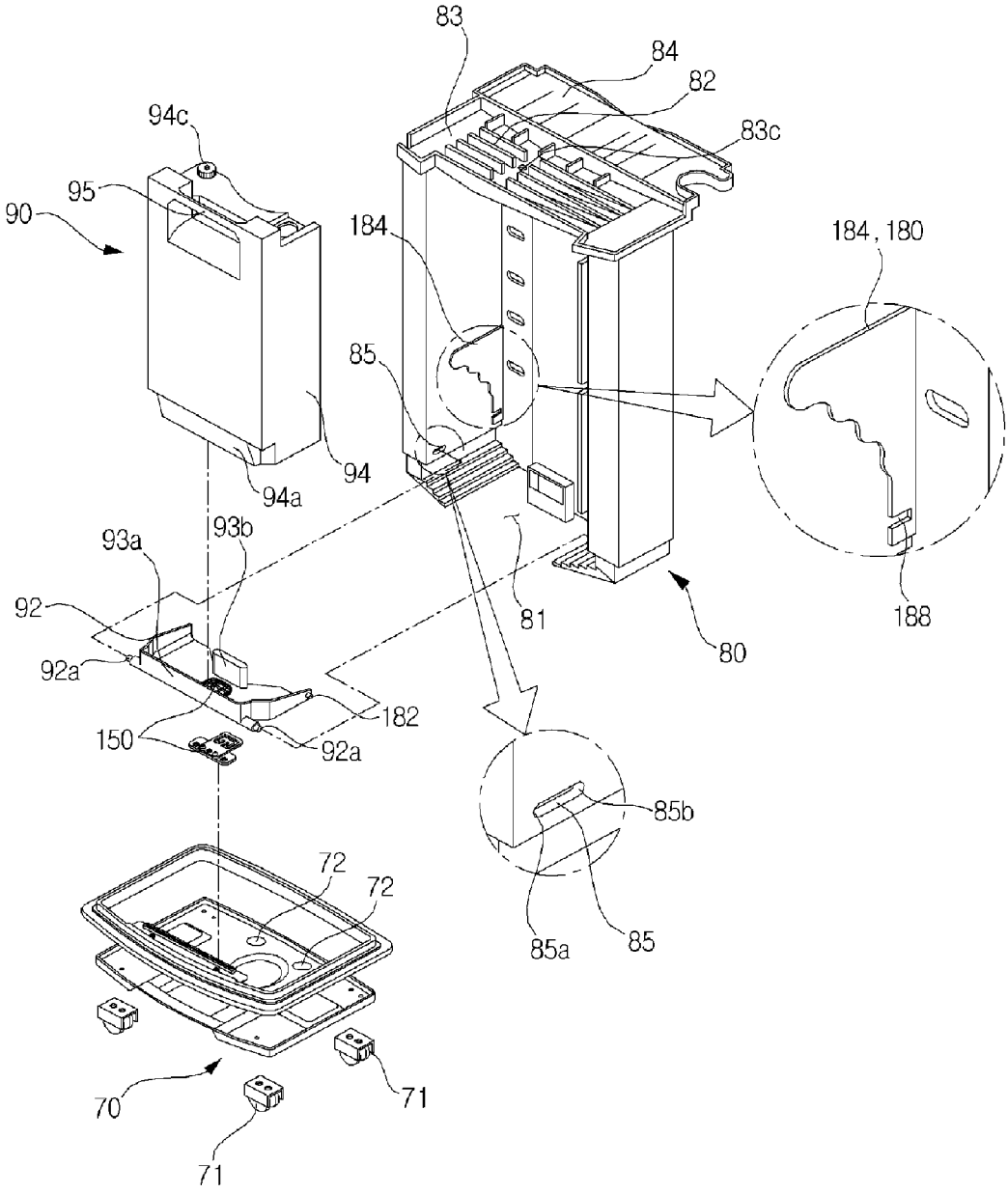

DEHUMIDIFIER

This application is a national phase entry of PCT Application No. PCT/KR2006/004347, filed Oct. 24, 2006, and claims the benefit of Korean Patent Application No. 10-2005-0100255, filed Oct. 24, 2005 and Korean Patent Application 10-2005-0100258, filed Oct. 24, 2005; each of the above-identified applications is incorporated by reference hereto in their entireties.

TECHNICAL FIELD

The present invention relates to a dehumidifier, and more particularly, to a de-humidifier having a bucket assembly received in a cabinet, which can be separated from a barrier by a stroke of action and can be temporally fixed on the barrier in the course of being separated from the barrier.

BACKGROUND ART

Generally, a dehumidifier is an apparatus for sucking indoor humid air into a cabinet, removing moisture from the humid air by allowing the humid air to pass through a heat exchanger having a condenser and a vaporizer along which refrigerants flow, then discharging the air from which the moisture is removed to an indoor room.

The humidifier includes a cabinet defining an outer appearance, a compressor installed in the cabinet and compressing refrigerants, a condenser for condensing the refrigerants compressed by the compressor by heat-exchanging the refrigerants with air, an expansion valve for expanding refrigerants condensed by the condenser, and a vaporizer for vaporizing the refrigerants expanded by the expansion valve by heat-exchanging the refrigerants with air, and a blower fan for forcedly directing the air into the cabinet.

With the above structure of the conventional dehumidifier, when the blower fan operates, the indoor air is sucked into the cabinet. The sucked air passes through the vaporizer. Then, the moisture contained in the air is condensed on a surface of the vaporizer, thereby removing the moisture from the indoor air. Then, the air whose moisture is removed is discharged out of the cabinet. During this process, the condenser water is stored in a bucket disposed in the cabinet and the user periodically empties the bucket.

However, in the conventional dehumidifier, when the user remove the bucket, the front upper and lower ends of the bucket are simultaneously separated toward the user, the bucket may be hooked by the cabinet in the coursed of removing the bucket through a sliding motion.

DISCLOSURE OF INVENTION

Technical Problem

Accordingly, the present invention is directed to a dehumidifier that substantially obviates one or more problems due to limitations and disadvantages of the related art.

An object of the present invention is to provide a dehumidifier in which a bucket can be separated by a stroke of action by allowing the bucket to be separated frontward from the cabinet while rotating.

Another object of the present invention is to provide a dehumidifier having a bucket that can be easily lifted by a user by allowing the bucket to move by a predetermined distance in a direction in which the user pulls the bucket.

Still another object of the present invention is to provide a dehumidifier having a bucket assembly that can temporally fixed by the interference with a barrier when the bucket assembly is separated from the cabinet.

Technical Solution

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a de-humidifier including: a cabinet defining an outer appearance of the dehumidifier; a barrier installed in the cabinet to collect condensed water; and a bucket assembly received in the barrier to store the condensed water, the bucket assembly being capable of pivoting frontward.

In another aspect of the present invention, there is provided a dehumidifier including: a cabinet defining an outer appearance of the dehumidifier; a base defining a bottom of the cabinet; a barrier installed in the cabinet to collect condensed water; a bucket assembly received in the barrier to store the condensed water, the bucket assembly being pivotally connected to the barrier by a hinge; and a hooking mechanism for temporally fixing the pivot poison of the bucket assembly when the bucket assembly pivots.

In still another aspect of the present invention, there is provided a dehumidifier including: a cabinet defining an outer appearance of the dehumidifier; a barrier installed on a bottom of the cabinet; a bucket assembly received in the barrier to store the condensed water; a pivotal mechanism for allowing the bucket assembly to pivot frontward of the barrier; and a hooking mechanism for temporally fixing the pivot poison of the bucket assembly when the bucket assembly pivots.

Advantageous Effects

According to the present invention, since an amount or level of the condensed water stored in the bucket by a level detecting unit or a weight detecting unit and a detected result is displayed on the display unit, the user can easily identify the amount or level of the condensed water stored in the bucket.

In addition, since the level of the condensed water stored in the bucket is visually transmitted to the user, the user can remove the condensed water out of the bucket before the bucket is fully filled with the condensed water.

Furthermore, since the bucket assembly is temporally fixed by a hooking member installed between the barrier and the bucket assembly during the bucket assembly pivots, a case where the bucket assembly falls down frontward during the bucket assembly is separated can be prevented.

In addition, since the bucket guide on which the bucket seats maintains the separated state even after the bucket is separated, the user can more easily mount the bucket.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings:

FIG. 1 is a perspective view of a dehumidifier according to an embodiment of the present invention;

FIG. 2 is an exploded perspective view of the dehumidifier of FIG. 1;

FIG. 3 is an exploded perspective view of a bucket assembly according to an embodiment of the present invention;

FIG. 4 is a perspective view of a barrier according to an embodiment of the present invention;

FIG. 5 is an exploded perspective view of a hooking mechanism between a bucket assembly and a barrier according to an embodiment of the present invention;

FIG. 6 is an operational view for illustrating a separating process of the bucket assembly according to an embodiment of the present invention;

FIG. 7 is an exploded perspective view of a filter assembly according to an embodiment of the present invention;

FIG. 8 is an operational view for illustrating a separating process of the filter assembly of FIG. 11;

FIG. 9 is a view illustrating an operation of the dehumidifier of the present invention;

FIG. 10 is an exploded perspective view of a bucket assembly according to another embodiment of the present invention; and FIG. 11 is an exploded perspective view of a bucket assembly according to another embodiment of the present invention.

BEST MODE FOR CARRYING OUT THE INVENTION

Reference will now be made in detail to the preferred embodiments of the present invention, examples of which are illustrated in the accompanying drawings. Wherever possible, the same reference numbers will be used throughout the drawings to refer to the same or like parts.

FIG. 1 is a perspective view of a dehumidifier according to an embodiment of the present invention and FIG. 2 is an exploded perspective view of the dehumidifier of FIG. 1.

Referring to FIGS. 1 and 2, a humidifier of the present invention includes a cabinet 60 defining an outer appearance, a compressor 10 installed in the cabinet 60 and compressing refrigerants, a condenser 20 for condensing the refrigerants compressed by the compressor by heat-exchanging the refrigerants with air, an expansion valve 30 for expanding refrigerants condensed by the condenser 20, and a vaporizer 40 for vaporizing the refrigerants expanded by the expansion valve 30 by heat-exchanging the refrigerants with air, and a blower fan assembly 50 for forcedly directing the air into the cabinet.

The dehumidifier of the present invention further includes a base 70 formed a bottom of the cabinet 60, a barrier 80 vertically installed on the base 70 and dividing the base into front and rear portions, a bucket assembly 90 installed on the barrier 80 to store the condensed water condensed on a surface of the vaporizer, and a filter assembly installed on an upper portion of the barrier 80 to filtering off foreign off foreign objects contained in air introduced into the cabinet 60 and directed to the blower fan assembly 50.

Describing in more detail, wheels 71 are installed on a bottom of the base 70 and the barrier 80 is installed on the base 70. With reference to the barrier 80, the bucket assembly 90 is installed on the front portion of the base 70 and the compressor is installed on the rear portion of the base 70.

In addition, the filter assembly, vaporizer 40, condenser 20, and blower fan assembly 50 are installed on the barrier 80 from the front portion to the rear portion in this order.

Here, the vaporizer 40 and the condenser 20 are spaced apart from each other and integrally coupled to each other. In order for the condensed water condensed by the vaporizer 40 to be effectively collected at the barrier 80, a drain pan 83 is formed on a top surface of the barrier 80. The vaporizer 40 and the condenser 20 are mounted on the drain pan 83.

Furthermore, an installation unit 84 formed at a higher location that the drain pan 83 is formed on the top surface of the barrier 80 and the blower fan assembly 50 is mounted on the installation unit 84.

The blower fan assembly 50 includes a housing 52 installed on the barrier 80, a centrifugal pan installed in the housing 52, a driving motor 55 for driving the centrifugal pan 54, and a housing cover 56 assembled with the housing g52 to guide air discharged from the centrifugal pan 54.

The housing 52 is provided with an air inlet 52*a* through which the air is sucked. The air accelerated by the centrifugal pan 54 after passing through the air inlet 52*a* is guided upward by the housing 52 and the housing cover 56.

The housing 52 divides an interior of the cabinet into front and rear portions so that the air introduced from the interior room can be directed to the centrifugal pan 54 through only an air inlet 52*a*.

Furthermore, the vaporizer/condenser 40/20 and the housing 52 are assembled with each other, and a control box 130 for controlling the humidifier is installed above the vaporizer/condenser 40/50 and the housing 5.

Meanwhile, the cabinet 62 includes a side panel 62 defining a side appearance, a rear panel 65 defining a rear appearance, a top panel 66 defining a top appearance, and a front panel assembly 140 defining a front appearance.

Here, the side panel 62, rear panel 65, are front panel assembly 140 are vertically disposed on a top surface of the base 70

The side panel 62 is provided with an inlet through which the air is introduced. The rear and front panels 65 and 68 are provided with respective air outlet 66 and 68*a* through which the air is discharged.

A louver 64 for controlling an induction direction of the air is installed in the inlet 63 of the side panel 62 and louvers 67 and 69 for controlling a discharging direction of the air are installed in the respective outlets 66 and 68*a* of the top panel 68.

Here, the louvers 64 and 67 installed on the respective side and rear panels 62 and 66 are designed to be adjusted by a user. The louver 69 installed on the panel 68 is designed to be controlled by a controller or the user.

At this point, the louver 69 is connected to the top panel 68 by a fin 69*a* so that it can pivot upward and downward. A motor (not shown) or a power transmission mechanism (not shown) may be installed on the top panel 67 so that the louver 69 can pivot by the control unit.

Meanwhile, the front panel assembly 140 includes a front frame 142 connected to the side panel 62 to pivot frontward, and a front panel 144 installed on a front surface of the front frame 142 so that it can be exposed to the user.

The peripheries of the front panel 144 and the front frame 142 are spaced apart by a predetermined distance. Therefore, the indoor air can be introduced into the cabinet 60 through a gap formed between the peripheries of the front panel 144 and the front frame 142.

A panel guide 146 is interposed between the front panel 144 and the front frame 142 at upper and lower ends.

In order for the air to flow toward the filter assembly disposed in rear of the front frame 142, the front frame 142 is provided with a plurality of holes 142*a* and slits 142*b*.

Furthermore, a bracket 145 is installed on an edge of the front frame 142 so that the front frame 142 can be connected to the side panel 62 by a hinge. The bracket 145 is formed at each of upper and lower ends of the side edge of the side panel 62 so that the front panel assembly 140 can be opened and closed in a hinge motion.

The following will describe the bucket assembly 90 according to an embodiment of the present invention.

FIG. 3 is an exploded perspective view of the bucket assembly.

Referring to FIG. 3, the bucket assembly 90 of this embodiment includes a bucket guide 92 hingedly connected to the base 70 to pivot frontward and a bucket 94 storing the condensed water and pivoting frontward together with the bucket guide 92.

That is, a pin-shaped hinge 92*a* protrudes from both ends of the bucket guide 92 and is coupled to the bracket 74 of the base 70. Therefore, the bucket guide 92 can pivot about the hinge 92*a*.

The bucket guide 92 includes first and second guide units 93*a* and 93*b* protruding upward to guide the accurate seating of the bucket 94.

Here, the first guide unit 93*a* is aligned with a groove 94*a* formed on a front-lower end of the bucket 94 and the second guide unit 93*b* is aligned with a groove 94*b* formed on a rear surface of the bucket 94.

The guide units 93*a* and 93*b* allows a water collecting hole (83*c* of FIG. 4) of the barrier 80 to be accurately aligned with an inflow hole 94*c* of the bucket 94.

In addition, a handle 95 is formed on an upper end of the bucket 94 so that the user uses the handle 95 when he/she intends to lift the bucket 94.

Therefore, when the user pulls frontward the handle 95 of the bucket 94, an upper end of the bucket 92*a* is pivoted frontward about the hinge 92*a*. Then, after the upper end of the bucket 94 moves out of a receiving portion (81 of FIG. 4) of the barrier 80, the user lifts the bucket 94 so that the bucket 94 can be completely separated from the bucket guide 91.

Here, although now shown in the drawing, the bucket guide 91 may be installed to be hingedly coupled to the barrier.

In addition, the bucket guide 92 is provided at opposite ends with a hook projection 182 for temporally fixing the bucket assembly 190 relative to the barrier 80 during the rotation of the bucket assembly 190. The hook projection 182 will be described later with reference to the accompanying drawing.

FIG. 4 is a perspective view of the barrier.

Referring to FIG. 4, the barrier 80 of this embodiment includes a receiving portion 81 for receiving the bucket assembly 90, a drain pan 83 formed on an upper portion to collect the condensed water, an installation portion 84 formed in rear of the drain pan 83 to support the blower fan assembly 50.

That is, a water collection hole 83*c* through which the condensed water collected in the drain pan 83 is directed to the inflow hole 94*c* of the bucket 94. Here, the water collection hole 83*c* is formed at a location corresponding to the inflow hole 94*c* of the bucket 83.

Meanwhile, a hook member 184 that is hooked on the hook projection 182 formed on the bucket guide 92 is formed on an inner surface 81*a* of the receiving portion 81.

The following will describe the hooking mechanism between the bucket assembly 90 and the barrier.

FIG. 5 is an exploded perspective view of the hooking mechanism between the bucket assembly and the barrier according to an embodiment of the present invention.

Referring to FIGS. 3 through 5, the hooking mechanism 180 of this embodiment includes a hook member 184 formed on both sides 81*a* of the receiving portion 81 of the barrier 80 and a hook projection 182 formed on both sides of the bucket guide 92 and interlock with the hook member 184.

The hook projection 182 is formed in rear of the bucket guide 92 and projected from the both sides of the bucket guide 92 toward both inner-side of the barrier 80.

Meanwhile, the hook member 184 interferes with the hook projection 182 to fix the bucket guide 92. The hook member 184 is formed on an inner surface 81*a* of the barrier 80.

Here, the hook member 184 protrudes inward from the inner surface 81*a* of the barrier 80. In order to interfere with the hook projection 182 rotating about the hinge 92*a*, the hook member 184 is provided with a indented surface 185 forwarding the bottom surface.

Describing in more detail, the indented surface 185 is formed in an arc-shape having a radius that is a distance between the hinge 92*a* and the hook member 184. At this point, the indented surface 185 includes a hook portion 185*a* formed at an angle similar to a horizontal direction and a supporting portion 185*b* formed at an angle similar to a vertical direction. The hook portion 185*a* is continued from the supporting portion 185*b*. That is, the indented surface 185 is formed with a plurality of step 186 each having the hook portion 185*a* and the supporting portion 185*b*.

Therefore, when the bucket guide rotates 92, the hook projection 182 performs a hooking action with the hook portion 185*a* while passing through each step 186. During this process, when the bucket guide 92 stops at one of the steps 186, the hook projection 182 contacts the supporting portion 185*b* to temporally stop the position of the bucket guide 92.

Meanwhile, although the hook projection 182 is formed on the bucket guide 92 and the hook member 184 is formed on the barrier in this embodiment, the hook projection 182 may be formed on the barrier 80 and the hook member 184 may be formed on the bucket guide 92.

The following will describe the separating process of the bucket assembly 90.

FIG. 6 is an operational view for illustrating a separating process of the bucket assembly.

Referring to FIGS. 5 and 6, the user opens the front panel assembly 140 to empty the bucket 94 storing the condensed water. Then, the front panel assembly 140 rotates about the bracket 145 of the side panel 62 to open the cabinet 60.

In addition, the user pulls the handle 95 of the bucket 94 to separate the bucket 94 from the barrier 80.

That is, since the bucket 94 is disposed on the bucket guide 92 and the bucket guide 92 rotates in a state where the hinge 92*a* is connected to the barrier 80, the upper end of the bucket 94 pivots frontward by the user pulling the bucket 94. At this point, the hook projection 182 of the bucket guide 94 rides across the indented surface of the hook member 184.

During this process, when the user stops the pivoting of the bucket 94 or lifts the bucket 94 from the bucket guide 92, the bucket guide 92 maintains its stopped state at its rotated angle by the hooking mechanism 180.

That is, the hook projection 182 formed on the bucket guide 92 is supported by the supporting portion 185*b* of the hook member 184 to maintain its stopped state.

As described above, as the user pulls the handle 95 of the bucket 94, the upper end of the bucket 94 is partly removed out of the barrier 80 to a location where the user can effectively lift the bucket 94. That is, when the user lifts the handle 95, the lower end of the bucket 94 is separated from the bucket guide 92.

Therefore, since the bucket 94 can be separated by the user grasping the handle at once, the separation of the bucket 94 can be conveniently realized.

Meanwhile, since the assembling of the bucket 94 is done in a reverse order, the detailed description thereof will be omitted herein.

FIG. 7 is an exploded perspective view of the filter assembly and FIG. 8 is an operational view for illustrating a separating process of the filter assembly.

Referring to FIG. 7, the filter assembly 120 of this embodiment includes a filter frame 122 assembled on the vaporizer 40, a filter case 124 coupled to the filter frame and being capable of pivoting frontward, and a fixing member 126 for fixing the filter case 124 to the filter frame 122.

A filter 128 for filtering off foreign objects contained in the air introduced into the humidifier is slidably installed in the filter case 124. The filter case 124 is pivotally assembled on a lower end of the filter frame 122.

The lower end of the filter case 124 is connected to the lower end of the filter frame 122 by a hinge 124*a*. The filter case 124 is opened while pivoting frontward about the hinge 124*a*.

Here, an elastic member such as a torsion spring is installed on the hinge 124*a* so that the filter case 124 pivots forward when the filter case 124 is separated from the filter frame 122.

In addition, a sliding guide 124*b* is formed on a rear surface of the filter case 124 so that the filter 128 can be slidably mounted in a longitudinal direction. Here, the sliding guide 124*b* is lengthily formed on upper and lower portions of a rear surface of the filter case 124 in a horizontal direction so that the filter 128 can be mounted in or removed from the filter case 124 through a sliding motion.

Meanwhile, the fixing member 126 is installed on the filter frame 122 and the filter case 124 is provided at an upper end with a hook 127 corresponding to the fixing member 126.

Here, the hook 127 is hooked and fixed on the fixing member 126 to fix the filter case 124 to the filter frame 122. This hooking of the fixing member 126 can be realized in a one-though type.

The separating and coupling of the filter assembly 120 will now be described with reference to FIG. 8. The user opens the front panel assembly 140 and separates the filter case 124 from the filter frame 122.

In a state where the filter case 124 is coupled to the filter frame 122, an upper end of the filter case 124 is pressed. Then, the hook 127 is pushed rearward of the fixing member 126 and returned to release the hook fixing state. Therefore, the upper end of the filter case 124 pivots frontward. Then, the filter 128 received in the filter case 124 gets out of the filter case 124.

Meanwhile, when it is intended to couple the filter assembly 120, the filter 128 is inserted in the filter case 124 through the sliding motion. Next, the upper end of the filter case 124 is pushed toward the filter frame 122. Then, the hook 127 is inserted into the fixing member 126 and then hooked and fixed while being pushed by a pre-determined distance frontward.

The following will describe the operation of the humidifier of this embodiment.

FIG. 9 is a view illustrating an operation of the dehumidifier of the present invention.

Referring to FIG. 9, when electric power is applied to the dehumidifier, the control unit installed in the control box 130 applies the power to the blower fan assembly 50 to introduce the indoor air into the cabinet 60 and discharge the introduced air to the room.

At this point, the indoor air is introduced through the air inlet 63 formed in the side panel 62, and the hole 142*a* and slit 142*b* formed in the front frame 142. The introduced air flows to the filter assembly 120 to filter off the foreign objects contained in the air.

Here, the foreign objects of the indoor air passing through the filter assembly 120 are filtered while the air passes through the filter 128. The air passing through the filter 128 is heat-exchanged with the vaporizer 40 after passing through the filter frame 122.

The filtered air heat-exchanges with discharge fins (not shown) formed on the vaporizer 40 and is thus cooled, in the course of which the moisture contained in the air is condensed on the surface of the vaporizer 40. The condensed water on the vaporizer 40 is collected in the drain pan 83 disposed on a lower portion of the vaporizer 40.

In addition, the air cooled while passing through the vaporizer is further heat-exchanged with the condenser 20 installed in rear of the vaporizer 40 to be heated again.

Here, since the condenser 20 emits heat during the condensing process of the vaporized refrigerants, the air from which the moisture is removed is heated to a temperature similar to that of the indoor air during the heat-exchanging process of the condenser 20.

After then, the air passing through the condenser 20 is guided to the housing 52 of the blower fan assembly 50. Then, the air guided into the housing 52 is accelerated by the centrifugal fan 54 installed in the housing 52 to be discharged to the room in a circumferential direction.

As described above, the dehumidifier of this embodiment sucks the air through the front and side surfaces and discharges the air through the top and rear surfaces. Therefore, the air can be directed in an every direction of the room in which the dehumidifier is installed.

Meanwhile, the control unit controls the air discharging direction and an amount of the air discharged by adjusting the rotational angle of the louver 69. Therefore, when the air is discharged upper-frontward of the cabinet 60, the louver 69 rotates rearward from the closed state to form the discharge hole frontward. When the air is discharged upper-rearward of the cabinet, the louver 69 rotates frontward from the closed state to form the discharge hole rearward.

Meanwhile, the condensed water condensed on the vaporizer 40 and collected in the drain fan 83 flows into the bucket 94 through the water collecting hole 83*c* of the drain fan 83.

An amount of the condensed water stored in the bucket 94 is detected by the full filling detecting unit 110 or the weight detecting unit 150. The control unit displays the amount of the condensed water in response to the amount of the condensed water stored in the bucket 94 on the display unit 135.

Especially, the weight detecting unit 150 measures the weight of the condensed water and calculate the water level of the bucket 94 using a test formula. The water level is displayed on the display unit 135 so that the user can identify the water level. When the bucket 94 is fully filled with the condensed water, the LEDs (not shown) of the display unit 135 are turned on so as to let the user to know the water discharging timing.

Furthermore, when the condensed water is filled in the bucket above a pre-determined level, the full filling detecting unit 110 detects this and transmits the same to the control unit. Then, the control unit stops the operation of the compressor 10 to prevent the condensed water from overflowing the bucket 94.

Meanwhile, although not shown in the drawing, the full filling detecting unit 110 may be installed to control power applied from the control unit to the compressor 10 so as to cut off the power applied to the control unit to the compressor 10 when the bucket is fully filled with the condensed water.

FIG. 10 is an exploded perspective view of a bucket assembly according to a second embodiment of the present invention, illustrating a weight detecting unit.

Referring to FIG. 10, this embodiment is identical to the foregoing embodiment of FIGS. 1 through 9 except that the bucket guide and the bucket are integrally formed and the hinge 192*a* of the bucket assembly 190 is installed in the groove 282 formed on the barrier 280 so that the bucket assembly 190 and the barrier 280 can be separated.

That is, the groove 282 guides the moving direction of the bucket assembly 190 when the bucket assembly 190 is separated from the barrier 280.

The following will describe the separating process of the bucket assembly 190.

First, when the user pulls the handle 95 of the bucket assembly 190, the bucket assembly 190 seating on the groove 282 of the barrier 280 rotates about the hinge 192*a*.

At this point, since a large amount of the condensed water is stored in the bucket assembly 190, a weight center of the bucket assembly 190 is formed at a lower portion of the bucket assembly and the bucket assembly 190 seats on an inner end 182*a* of the groove 292 to which the hinge 192*a* seats and rotates.

When the user lifts the bucket assembly 190, the hinge 192*a* moves along the groove 282 and is separated from the barrier 280.

Here, the groove 282 formed on the barrier 280 has an outer end inclined upward so that the bucket assembly 190 can be smoothly separated from the barrier when the user lifts the bucket assembly 190.

Furthermore, the hooking mechanism 180 installed between the bucket assembly 190 and the barrier 280 generates interference between the bucket assembly 190 and the barrier 280 while the bucket assembly 190 is separated along the groove 282.

Here, the hooking mechanism 180 has the indented surface having a water wave shape, each indented unit of which has an angle similar to that of the groove. Therefore, in the course of separating the bucket assembly 190, the bucket assembly 190 can be temporally fixed.

Since other structures of this embodiment are identical to those of the embodiment of FIGS. 1 through 9, the detailed description thereof will be omitted herein.

FIG. 11 is an exploded perspective view of an bucket assembly according to another embodiment of the present invention.

Referring to FIG. 11, this embodiment is same as the embodiment of FIGS. 1 through 9 except that the hinge 92*a* is not connected to the bracket (74 of FIG. 2) but installed in the groove 85 formed on the barrier so that the bucket guide 92 moves frontward or rearward through the sliding motion.

That is, the groove 85 is a guide for allowing the bucket 92 to move frontward when the user pulls the bucket 94. The groove 82 is horizontally formed in a front-rear direction.

Therefore, when the user pulls the handle 94, the bucket 94 and the bucket guide 92 move out frontward along the groove 85 formed on the barrier 80. In this state, when the user lifts the bucket 94, the bucket is separated from the bucket guide 92.

At this point, the hinge 92*a* formed on the bucket guide 92 linearly moves along the groove 85 when the bucket 94 moves out. When the hinge 92*a* is hooked on the front end 85*a*, the movement of the bucket guide 92 is stopped and pivoted frontward.

In addition, the linear movement and pivoting of the bucket guide 92 may be sequentially or simultaneously generated according to a withdraw angle at which the user pulls the bucket 94.

Meanwhile, the hook member 184 is provided with a rail 188 corresponding to the groove 85 of the bucket guide 92.

Therefore, when the bucket guide 92 moves from a rear end 85*b* of the groove 85 to a front end 85*a* of the groove 85, the hook projection 182 of the bucket guide 92 moves frontward along the rail 188 of the hook member 184 and the hinge 92*a* of the bucket guide 92 hooks on the front end 85*a* of the groove 85. Thus, when the bucket guide 92 rotates, the hook projection 182 moves out of the rain 188 to interfere with the indented surface 185 of the hook member 184.

Here, although not shown in the drawing, the groove 85 of the barrier 80 may be formed on an inner surface of the bracket (74 of FIG. 2) and the cabinet 60 of the base disclosed in the embodiment of FIGS. 1 through 9.

It will be apparent to those skilled in the art that various modifications and variations can be made in the present invention. Thus, it is intended that the present invention covers the modifications and variations of this invention provided they come within the scope of the appended claims and their equivalents.

INDUSTRIAL APPLICABILITY

According to the dehumidifier of the present invention, since the bucket assembly is provided to be capable of pivoting relative to the barrier, the user can easily empty the bucket containing the condensed water. since the bucket assembly is temporally fixed by a hooking member installed between the barrier and the bucket assembly during the bucket assembly pivots, a case where the bucket assembly falls down frontward during the bucket assembly is separated can be prevented. Therefore, the industrial applicability of the present invention is very high.

The invention claimed is:

1. A dehumidifier comprising:

a cabinet defining an outer appearance of the dehumidifier;

a barrier installed in the cabinet to collect condensed water;

a base defining a bottom of the cabinet;

a bucket assembly received in the barrier to store the condensed water, the bucket assembly being capable of pivoting frontward, wherein the bucket assembly includes:

a bucket guide provided at both sides with a hinge, the bucket guide being rotatably coupled to the base; and a bucket seated on the bucket guide to store the condensed water, wherein the bucket is designed to be separable from the barrier and the bucket rotates together with the bucket guide; and a hooking mechanism for temporally fixing the bucket assembly by generating interference between the barrier and the bucket assembly when the bucket assembly pivots, wherein the hooking mechanism comprises:

a hook member formed on one of the bucket assembly and the barrier; and a hook projection formed on the other of the bucket assembly and the barrier to generate the interference with the hook member.

2. The dehumidifier according to claim 1, wherein the bucket guide is provided with a guide unit for guiding the seating of the bucket.

3. The dehumidifier according to claim 2, wherein the guide unit includes a first guide for guiding the seating of a front end of the bucket and a second guide for guiding the seating of a rear end of the bucket.

4. The dehumidifier according to claim 1, wherein the base is provided with a bracket to which the hinge is coupled.

5. The dehumidifier according to claim 1, wherein the hook member is formed in an arc-shape having a radius of the hinge of the bucket assembly.

6. The dehumidifier according to claim 1, wherein the hook member is provided with an indented surface for interfering with the hook projection.

7. The dehumidifier according to claim 6, wherein the indented surface comprises:

a hook portion interfering with the hook projection when the bucket assembly pivots; and a supporting portion for supporting the hook projection when the pivoting of the bucket assembly stops.

8. A dehumidifier comprising:

a cabinet defining an outer appearance of the dehumidifier;

a base defining a bottom of the cabinet;

a barrier installed in the cabinet to collect condensed water;

a bucket assembly received in the barrier to store the condensed water, the bucket assembly being pivotally connected to one of the barrier and the base by a hinge; and a hooking mechanism for temporally fixing the pivot position of the bucket assembly when the bucket assembly pivots, wherein the hooking mechanism comprises:

a hook member formed on one of the bucket assembly and the barrier; and a hook projection formed on the other of the bucket assembly and the barrier to generate interference with the hook member.

9. The dehumidifier according to claim 8, wherein one of the base connected to the bucket assembly and the barrier is provided with a groove for guiding the linear motion of the bucket assembly.

10. The dehumidifier according to claim 8, wherein the bucket assembly comprises:

a bucket guide having a hinge; and a bucket seated on the bucket guide to store the condensed water.

11. The dehumidifier according to claim 8, wherein the hook member is formed in an arc-shape having a radius of the hinge of the bucket assembly and the hook member is provided with an indented surface for interfering with the hook projection.

12. The dehumidifier according to claim 11, wherein the indented surface comprises:

a hook portion interfering with the hook projection when the bucket assembly pivots; and a supporting portion for supporting the hook projection when the pivoting of the bucket assembly stops.

13. A dehumidifier comprising:

a cabinet defining an outer appearance of the dehumidifier;

a barrier installed on a bottom of the cabinet;

a bucket assembly received in the barrier to store the condensed water;

a pivotal mechanism for allowing the bucket assembly to pivot frontward of the barrier; and a hooking mechanism for temporarily fixing the pivot position of the bucket assembly when the bucket assembly pivots, wherein the pivotal mechanism comprises a hinge formed at the bucket assembly and a receiving portion defined at the barrier for receiving the hinge, wherein the receiving portion is extended in a frontward-rearward direction to guide the movement of the hinge, wherein the hinge is removably received in the receiving portion, and wherein a hook member is formed on one of the bucket assembly and the barrier and a hook projection is formed on the other of the bucket assembly and the barrier to generate interference with the hook member.

* * * * *